US005275656A

United States Patent [19]

Jendroska

[11] Patent Number: 5,275,656

[45] Date of Patent: Jan. 4, 1994

[54] APPARATUS FOR APPLYING LIQUID MEDIA ONTO A WEB

[75] Inventor: Rainer Jendroska, Greven, Fed. Rep. of Germany

[73] Assignee: Windmoller & Holscher, Lengerich, Fed. Rep. of Germany

[21] Appl. No.: 699,379

[22] Filed: May 15, 1991

[30] Foreign Application Priority Data

May 15, 1990 [DE] Fed. Rep. of Germany ..... 4015631
Oct. 11, 1990 [DE] Fed. Rep. of Germany ..... 4032318

[51] Int. Cl.[5] ..... B05C 1/08
[52] U.S. Cl. ..... 118/46; 118/249; 118/258
[58] Field of Search ..... 118/46, 249, 258

[56] References Cited

U.S. PATENT DOCUMENTS

| | | | |
|---|---|---|---|
| 2,473,243 | 6/1949 | Ettl | 118/249 |
| 4,354,449 | 10/1982 | Zink | 118/246 |
| 4,495,886 | 1/1985 | Phelps | 118/249 |
| 5,109,768 | 5/1992 | Lübke et al. | 101/153 |
| 5,117,768 | 6/1992 | Seymour | 118/249 |

FOREIGN PATENT DOCUMENTS

| | | |
|---|---|---|
| 0142925 | 5/1985 | European Pat. Off. . |
| 8706504 | 11/1987 | World Int. Prop. O. . |

*Primary Examiner*—W. Gary Jones
*Assistant Examiner*—Steven P. Griffin
*Attorney, Agent, or Firm*—Keck, Mahin & Cate

[57] ABSTRACT

The invention refers to an apparatus for applying liquid media onto a web with an applicator roller carried in a machine frame and an impression roller which can be lifted thereoff and adjusted thereto, said impression roller forming a roller gap with the applicator roller, through which the web passes. For the solution of the problem to provide an apparatus with a simple and robust design, in which a desired gap between the impression roller and the applicator roller can be easily set, the impression roller is mounted between the one arms of two parallel two-armed levers being pivotably supported in the machine frame. At the ends of the other arms one end of a pressure piston cylinder unit pivoting the two-armed levers is coupled, the other end of which is mounted in the machine frame. Furthermore, at least one stopper is provided which is allocated to one of the lever arms, arranged in the machine frame, adjustable as to height, and by which the width of the roller gap is limited.

12 Claims, 3 Drawing Sheets

APPARATUS FOR APPLYING LIQUID MEDIA ONTO A WEB

BACKGROUND OF THE INVENTION

1. Field of the Invention

The invention refers to an apparatus for applying liquid media onto a web with an applicator roller carried in a machine frame and an impression roller which can be lifted thereoff and adjusted thereto, said impression roller forming a roller gap with the applicator roller, through which the web passes.

2. Description of Prior Art

Unpublished German patent application P 39 15 481.5 discloses an apparatus of this kind for adjusting and lifting a counterpressure cylinder to and off a form cylinder of a rotary printing machine. Corresponding to the different diameters of the used form cylinders, in this known rotary printing machine the counterpressure cylinder does not only have to widely travel along a relatively long path, when the form cylinder is changed, the counterpressure cylinder also has to be adjustable to the form cylinder in the manner that it meets the form cylinder from above in a vertical direction to thereby render possible the making of a constant printing image. For the realization of the long path of movement of the counterpressure cylinder and its vertical meeting of the impression cylinder in the known apparatus, the center axis thereof is moved in a vertical plane extending through the center axis of the form cylinder by high-precision adjustment spindles.

There are apparatus of the kind mentioned above in which not the same high requirements are to be made with respect to the lifting-off movement and the adjusting movement of an impression roller, as are demanded for a high-quality rotary printing machine.

SUMMARY OF THE INVENTION

It is an object of the invention to provide an apparatus of the kind mentioned hereinbefore, which has a simple and robust design and in which a desired gap between the impression roller and the applicator roller can be easily set.

According to the invention this problem is solved for an apparatus of the generic type in that the impression roller is mounted between the one arms of two parallel two-armed levers being pivotably supported in the machine frame, that at the ends of the other arms one end of a pressure piston cylinder unit pivoting the two-armed lever is coupled, the other end of which is mounted in the machine frame, and that at least one stopper is provided which is allocated to the lever arms, arranged in the machine frame, adjustable as to height, and by which the width of the roller gap is limited. In the apparatus according to the invention, the impression roller can be lifted off and also adjusted to the applicator roller in a simple manner in that it is mounted between the parallel arms of a pair of two-armed levers being supported rocker-like, which can be pivoted by a pressure piston cylinder unit. Therein, the two-armed levers pivotable in pairs are connected through transversal bars or the like to a two-armed supporting frame which then can also be pivoted by a single pressure piston cylinder unit. The apparatus according to the invention is preferably intended for applicator rollers with only little differences in diameter so that, despite the lifting and adjusting of the impression roller by pivoting, a sufficiently precise adjustment movement is obtained.

Despite the fact that the apparatus according to the invention in principle can also be applied in printing machines, it is preferably used for the coating of webs with paint, adhesive or similar materials. When using corresponding applicator rollers, the webs passing through the roller gap can also be supplied with coatings e.g. at the edges or other certain spots, as is for instance required for a glueing of predetermined regions of webs of paper or synthetic material in the manufacturing of sacks.

For the coating of webs with paint, adhesive or the like it is necessary to operate with a roller gap of an exactly adjustable width. In the apparatus according to the invention, the desired width of the roller gap can be easily adjusted by the stoppers which can be set accordingly when installing the apparatus. The stoppers can also be set to the desired width by automatic setting means.

For the replacement of the rollers, particularly of the impression roller after wear or soiling, said impression roller can be lifted off the applicator roller by the desired amount by means of pivoting the rocker-like frame.

The liquid media with which the web is to be coated can be supplied to the applicator roller by means of a transfer roller being adjusted thereto which forms a trough-like roller gap with a roller adjusted to it, to which the medium to be applied is supplied. In order to prevent the medium to be applied from flowing out of the trough-like roller gap, at the front sides of both rollers baffle plates or the like are arranged. The amount or the film thickness of the layer to be applied to the applicator roller can be set by the number of revolutions of the transfer roller.

If for the replacement of the impression roller, for instance, the latter is to be lifted off the applicator roller, for the carrying out of a large travel movement, the two-armed pivoting frame is correspondingly pivoted by the pressure piston cylinder unit.

Advantageously, the cylinder of the pressure piston cylinder unit is a pneumatic cylinder which holds the lever arm engaged with the stopper when pressurized air is applied in the adjustment direction. Thereby, on the one hand, the roller gap given by the stopper is maintained and, on the other hand, the pneumatic cylinder acts as a resilient element so that the impression roller can be resiliently lifted off the applicator roller, if desired.

In a further embodiment of the invention it is provided that the stopper is arranged at a spindle adjustable by a servomotor which drives the spindle at a torque moving the spindle with a force being smaller than the force required for the lifting off of the impression roller resting on the applicator roller. Then, for the setting of the desired roller gap it is only necessary to deareate the pneumatic cylinder so that the impression roller is laid upon the applicator roller under the effect of gravitational force. Subsequently, the stopper or the stoppers can be laid upon the corresponding arms of the two-armed lever or the two-armed frame and then adjusted according to the desired roller gap. Then, for starting the operation, the pneumatic cylinder is again applied with pressure so that it holds the lever arms or the frame in engagement with the stopper(s) by maintaining the set roller gap.

Advantageously, the pneumatic cylinder is a clamping cylinder which can be clamped such that the piston in the cylinder is fixed in the respective clamped position. Thus, in the clamped position any resilient effect of the pneumatic cylinder is cancelled. When the pneumatic cylinder is now fixed by clamps in the position in which the impression roller is let down upon the applicator roller, the stopper(s) can be moved towards the lever arms or the frame without the risk of displacement, since the torque of the servomotors is too low to overcome the clamping force of the clamping cylinder(s).

In a further development of the invention it is provided that the gear driving the spindle has a graduated disk. For the setting of the roller gap, the respective desired width of the gap can be read off the graduated disk.

In a further development of the invention an initiator is assigned to the graduated disk, said initiator generating signals in accordance with small angular steps. Then, the servomotor can be controlled through said signals such that the setting of the width of the roller gap can be carried out automatically.

According to a further development of the invention it is provided that a second pair of parallel two-armed levers is mounted for pivoting movement around the pivoting axis of the two-armed levers carrying the impression roller, and that between the arms of said second pair of levers a supporting roller adjustable to the impression roller is mounted and that to the other arms thereof one end of the pressure piston cylinder unit is coupled. Said supporting roller can be advantageously or necessarily provided in certain embodiments for the additional support of the impression cylinder. By the pivotal arrangement according to the invention, a pivoting of the support roller off the impression roller and subsequently of the impression roller off the applicator roller is permitted.

Advantageously, for the common pivoting of the levers carrying the impression roller and the supporting roller in lift-off direction, at least one lever arm is provided with a stopper which only then engages with the other lever arm when the supporting roller is lifted off the impression roller by a certain distance. By said design it is rendered possible to easily obtain the necessary distance between the rollers required in case of a replacement or for maintenance purposes.

Advantageously, one of the lever arms being opposite to each other with a stopper adjustable via a spindle drive is supported on the other lever arm. A part of the supporting force can thereby be branched off via the stopper.

For the setting of the roller gap, the spindle drive can be drivable by an air motor and the gear can be provided with a setting means having a scale.

Embodiments of the invention will now be described in the following with reference to the drawing.

DETAILED DESCRIPTION OF PREFERRED EMBODIMENTS

Figure 1:
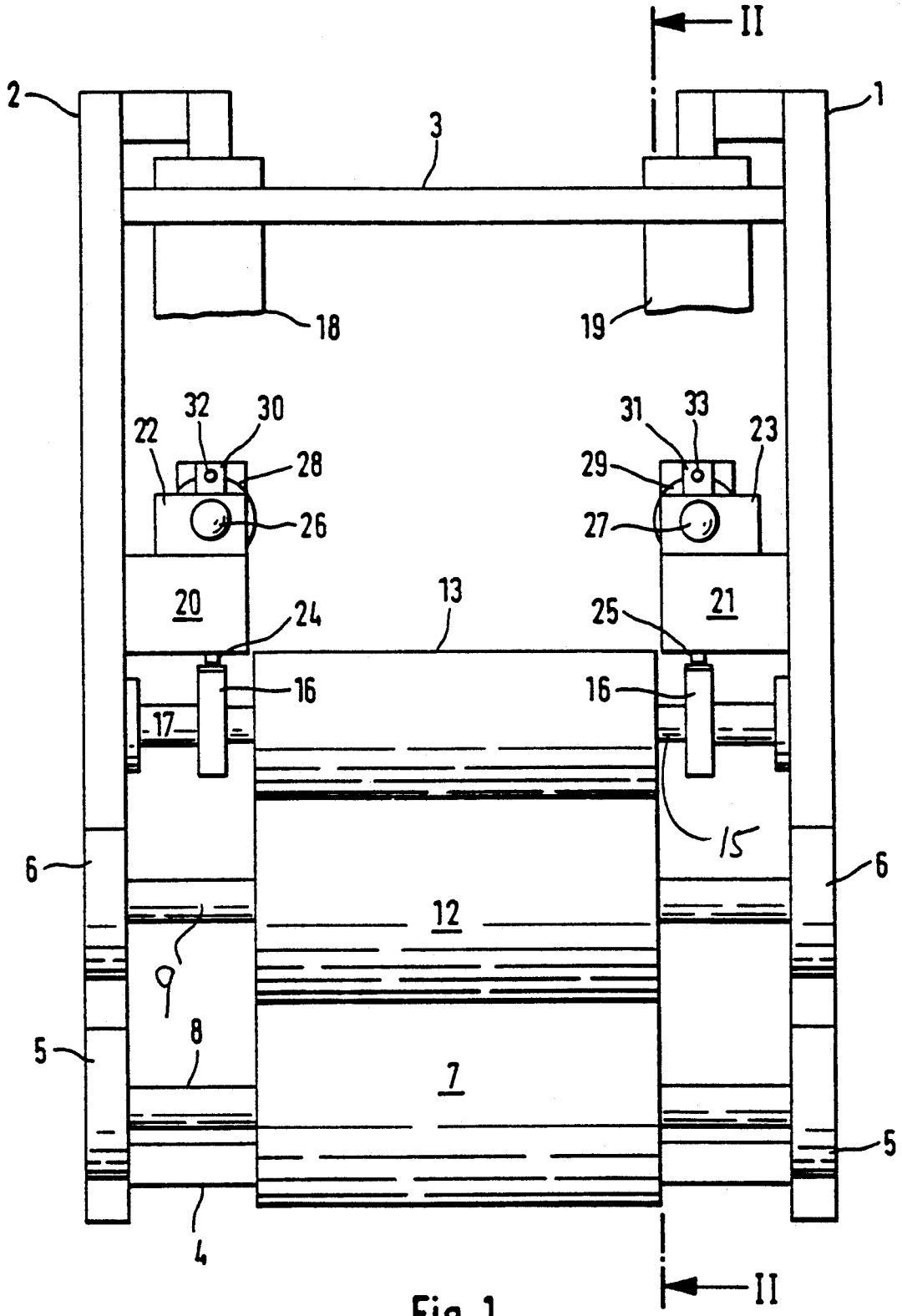
FIG. 1 shows a front view of the apparatus for applying liquid media onto a web.

The machine frame substantially consists of the side frames 1, 2 interconnected through transversal bars 3, 4.

The lower applicator roller 12 which is drivably mounted through shaft 9 in the plummer blocks 6, is in contact with the transfer roller 7 The upper impression roller 13 cooperates with said lower applicator roller 12, through the roller gap of which the web 14 is passed. The upper impression roller 13 is located on a shaft 15 mounted freely rotatably between pivoting levers 16. The latters are provided with journals 17 being rotatably mounted in the side frames 1 and 2.

Via the journals 17, the upper impression roller 13 is adjustable through piston cylinder units 18 and 19. Both piston cylinder units are designed as clamping cylinders.

Figure 2:
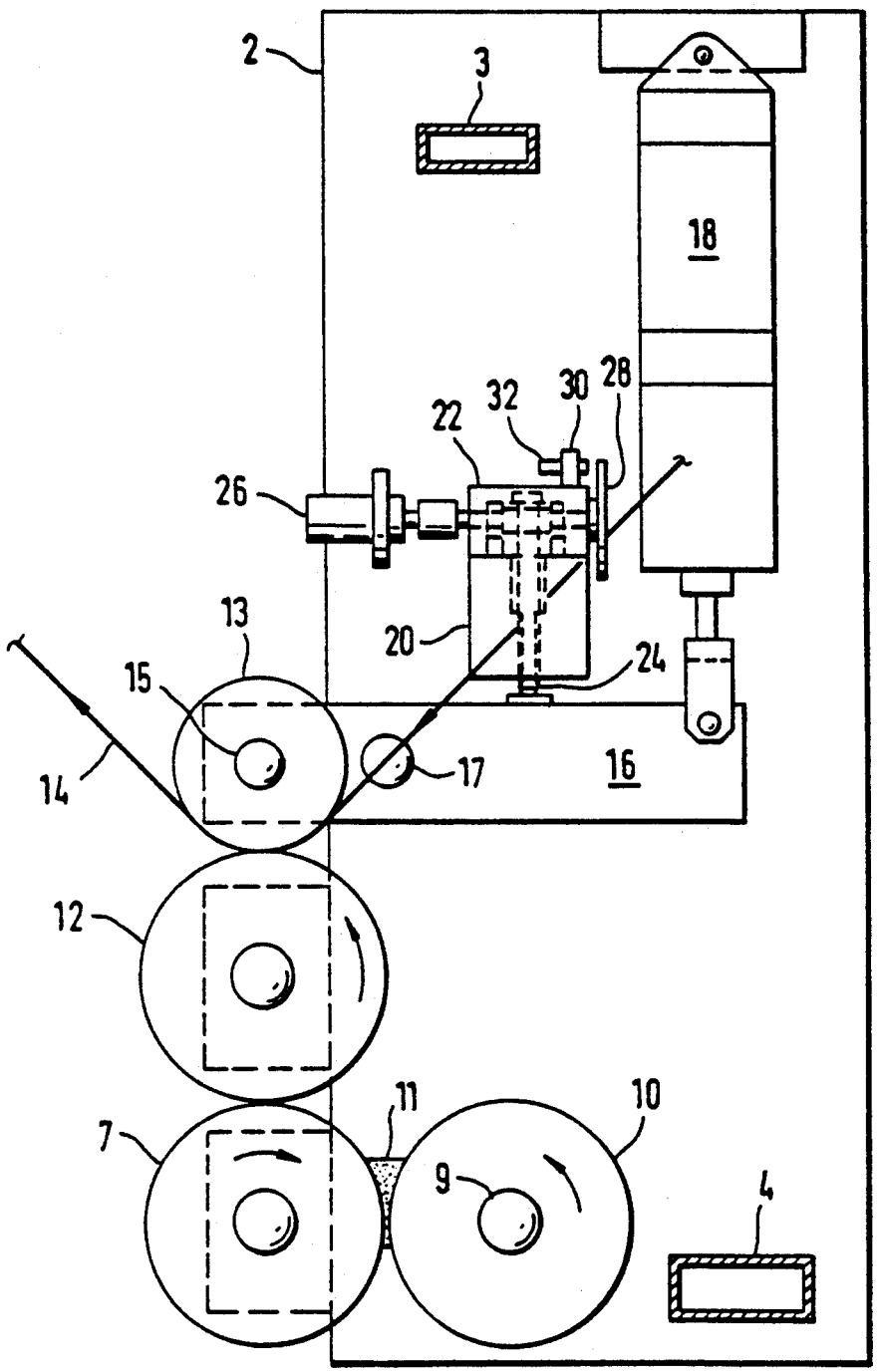
FIG. 2 shows a side view of the apparatus taken on the line II—II in FIG. 1.

In FIGS. 1 and 2 there is shown that above the pivoting lever 16 support profiles 20 and 21 are fixedly connected with the side frames 1 and 2 on which gear casings 22 and 23 are arranged. From said gear casings 22 and 23, respectively an adjustable stopper 24 and 25 projects downwardly towards which the pivoting levers 16 are drawn by the piston cylinder units 18 and 19 and thus fixed in their position. The stoppers 24 and 25 are adjustable as to height through the air motors 26 and 27 flange-mounted to the gear casings 22 and 23. The air motors themselves only have a very low torque.

If for instance the upper impression roller 13 is worn out and is to be replaced by a new one, the piston rods of the piston cylinder units 18 and 19 are extended, thereby pivoting the upper impression roller 13 off the lower applicator roller 12. Thereupon, the upper impression roller 13 is replaced by a new one. During this time, the stoppers 24 and 25, which can be designed as displacement spindles, have been retracted through the motors 26 and 27. Then the piston rods of the piston cylinder units 18 and 19 are drawn in such that after its replacement, the upper impression roller 13 comes to lie on the lower applicator roller 12 only with its own weight. At this point of time, the web 14 is not located between the two rollers 12 and 13. When the upper applicator roller comes to lie upon the lower applicator roller, the piston cylinder units 18 and 19 are clamped. This means that the pistons are stationary fixed in the cylinder space. Then the stoppers 24 and 25 are lowered by the air motors 26 and 27 until they are supported on the pivoting levers 16. Since the motors 26 and 27 are designed as air motors only having a very low torque, it is ensured that the stoppers 24 and 25 are always supported against the pivoting levers 16 with an exactly defined force. When this has been carried out, the motors 26 and 27 are switched off and the pistons of the piston cylinder units 18 and 19 are extended again. Thus, the stoppers 24 and 25 no longer show any contact with the pivoting lever 16.

The upper impression roller 13 can have a steel core with a rubber jacket corresponding in its axial extension approximately to the width of the web 14 to be coated to thereby possibly avoid smearing of the impression roller. This, however, is not always possible so that in the course of time smaller glue incrustations, particularly in the edge sections of the rubber jacket are formed. In such cases, the upper impression roller 13 must be removed and the surface of the rubber jacket must be ground. This results in a reduction of the diameter of the upper impression roller 13 so that it is necessary to readjust the impression roller 13 with respect to the applicator roller 12, on the one hand, and to readjust the roller 34 in the embodiment according to FIG. 3 with respect to the impression roller 13, on the other hand. Such a readjustment is also necessary, when the width of the web 14 to be coated is changed, since also in this case it is necessary to replace the upper impression roller 13, wherein the rubber jacket in its axial extension respectively corresponds approximately to the width of the web 14 to be coated. Such an adjustment can be realized by means of the device represented in FIG. 3.

In principle, the lower applicator roller 12 consists of steel so that it usually need not be replaced.

When the apparatus according to FIGS. 1 and 2 for the coating of a web, e.g. with wax, is used, only a minor tensile stress is required in the web 14. But if e.g. a solution-free adhesive is to be applied, high web tensions are required which make it necessary that the upper impression roller is additionally supported by a supporting roller 34 in the manner shown in FIG. 3.

In order to be able to set an exactly defined roller gap between the impression roller 13 and the transfer roller 12 it is necessary to further extend the stoppers 24 and 25 by an exactly defined amount. For this purpose, a graduated disk 28 and 29 is respectively rotatably connected with the gear casings 22 and 23, the position of said graduated disks 28 and 29 being determined by initiators 32 and 33 mounted to holders 30 and 31. By a repeated operation of the motors 26 and 27 the graduated disks 28 and 29 are rotated by precalculated amounts, said amounts precisely corresponding to the degree by which the stoppers 24 and 25 must be further extended. When this has been carried out, the piston rods of the piston cylinder units 18 and 19 are again retracted so that then the pivoting levers 16 engage the stoppers 24 and 25 extended by an exactly determined amount. The applicator roller 12 and the impression roller 13 then show exactly that roller gap which is inevitably required for the web to be used and for the layer thickness to be applied.

Figure 3:
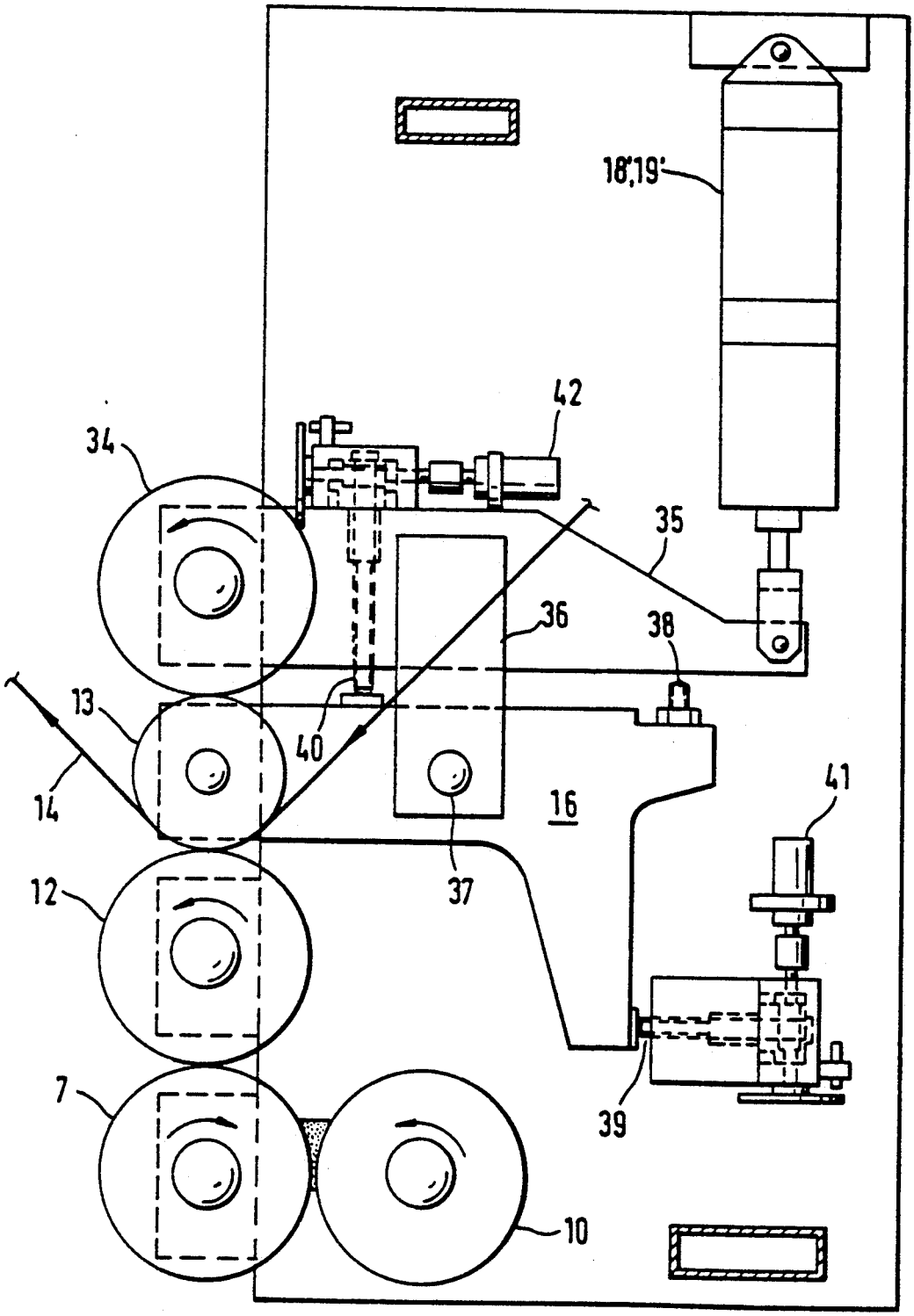
FIG. 3 shows a representation corresponding to FIG. 2 of a modified embodiment with a supporting roller supporting the impression roller.

In individual cases it may be necessary to additionally support the upper impression roller 13. The manner in which this is carried out according to the invention is shown in FIG. 3. Therein, the upper impression roller 13 can be seen to which a supporting roller 34 is assigned. The supporting roller 34 is mounted between two arms 35 with which holders 36 are fixedly screw-connected. Each of said holders 36 is pivotably mounted on the axis or shaft 37 on which also the levers 16 are mounted. If now, for instance, the upper impression roller 13 is to be replaced by another one, the arms 35 are pivoted by means of the piston cylinder units 18' and 19' around the shaft 37 in clockwise direction until the arms 35 engage the stoppers 38. When this has been carried out, also the pivoting levers 16 are pivoted around the shaft 37 mounted in the side frames so that a roller gap is formed between the supporting roller 34 and the upper impression roller 13 on the one hand and between the upper impression roller 13 and the lower applicator roller 12 on the other hand. Then the new impression roller 13 can be inserted while in the meantime the stoppers 39 and 40 are retracted. Then the piston rods of the piston cylinder units 18' and 19' are retracted e.g. by connecting the cylinder spaces to the atmosphere so that the roller 13 comes to lie on the roller 12 and the roller 34 on the roller 13. When this has been carried out, the piston cylinder units 18' and 19' are clamped and the stoppers 39 and 40 are extended via the air motors 41 and 42 to such a degree that they contact the pivoting levers 16 or the arms 35. Then the piston rods of the piston cylinder units are again extended and the rollers 13 and 34 are pivoted around the shaft 37 in clockwise direction. Corresponding to the desired roller gap between the rollers 12 and 13, the stoppers 39 and 40 are further extended by an exactly defined degree and thereupon the piston rods of the piston cylinder units 18' and 19' are retracted and the pivoting levers 16 are drawn towards the stoppers 39 and the arms 35 towards the stoppers 40 and held thereat. During operation, the air pressure in the piston cylinder units 18 and 19 or 18' and 19' is always maintained.

I claim:

1. Apparatus for applying liquid media onto a web with an applicator roller carried in a machine frame and an impression roller which can be lifted thereoff and adjusted thereto, said impression roller forming a roller gap with the applicator roller, through which the web passes, wherein the impression roller (13) is mounted between first ends of two parallel two-armed levers (16) pivotably supported in the machine frame, and at second ends of each of the two-armed levers, a first end of a pressure piston cylinder unit (18, 19) for pivoting the two-armed levers (16) is coupled, a second end of each piston cylinder unit (18, 19) is mounted in the machine frame, and at least one stopper (24, 25) is provided which is allocated to the two-armed levers, arranged in the machine frame, adjustable as to height, and by which the width of the roller gap is limited.

2. Apparatus according to claim 1, wherein the two-armed levers (16) are pivoted off the at least one stopper (24, 25) by means of the pressure piston cylinder units (18, 19) for moving the impression roller.

3. Apparatus according to claim 1, wherein the cylinder of each pressure piston cylinder unit is a pneumatic cylinder (18, 19) which holds the two-armed levers (16) engaged with the at least one stopper (24, 25) when pressurized air is applied to the cylinder to maintain the roller gap width.

4. Apparatus according to claim 1, wherein the at least one stopper (24, 25) is arranged at a spindle adjustable by a servomotor (26, 27) which drives the spindle at a torque moving the spindle with a force smaller than the force required for lifting off the impression roller (13) resting on the applicator roller (12).

5. Apparatus according to claim 4, wherein the cylinder of each pressure piston cylinder unit (18, 19) is a clamping cylinder.

6. Apparatus according to claim 5, wherein the torque of the servomotors (26, 27) is lower than the force to overcome a clamping force of the clamping cylinder.

7. Apparatus according to claim 4, wherein a gear driving the spindle has a graduated disk (28, 29) rotatably connected with a casing for the gear.

8. Apparatus for applying liquid media onto a web with an applicator roller carried in a machine frame and an impression roller which can be lifted thereoff and adjusted thereto, said impression roller forming a roller gap with the applicator roller, through which the web passes, wherein the impression roller (13) is mounted between first ends of two parallel two-armed levers

(16) pivotably supported in the machine frame, and at second ends of each of the two-armed levers, a first end of a pressure piston cylinder unit (18, 19) for pivoting the two-armed levers (16) is coupled, a second end of each said piston cylinder unit (18, 19) is mounted in the machine frame, and at least one stopper (24, 25) is provided which is allocated to the two-armed levers, arranged in the machine frame, adjustable as to height, and by which the width of the roller gap is limited, wherein the at least one stopper (24, 25) is arranged at a spindle adjustable by a servomotor (26, 27) which drives the spindle at a torque moving the spindle with a force smaller than the force required for lifting off the impression roller (13) resting on the applicator roller (12), wherein a gear driving the spindle has a graduated disk (28, 29) rotatably connected with a casing for the gear, and wherein the graduated disk (28, 29) cooperates with an initiator (30, 32; 31, 33) held in the gear casing to determine positioning of the graduated disk.

9. Apparatus for applying liquid media onto a web with an applicator roller carried in a machine frame and an impression roller which can be lifted thereoff and adjusted thereto, said impression roller forming a roller gap with the applicator roller, through which the web passes, wherein the impression roller (13) is mounted between first ends of a first pair of parallel two-armed levers (16) pivotably supported in the machine frame, said first pair of two-armed levers being pivotably connected to a second pair of two-armed levers and at second ends of each of the second pair of two-armed levers, a first end of a pressure piston cylinder unit (18', 19') for pivoting the first and second pairs of two-armed levers (16, 35) is coupled, a second end of each said piston cylinder unit (18', 19') is mounted in the machine frame, and at least one stopper is provided which is allocated to the two-armed levers, arranged in the machine frame, and adjustable as to height, and by which the width of the roller gap is limited, wherein the second pair of parallel two-armed levers (35) is mounted for pivoting movement around pivoting axes (37) of the first pair of two-armed levers (16) carrying the impression roller (13), and wherein between first ends of said second pair of two-armed levers a supporting roller (34) adjustable relative to the impression roller (13) is mounted.

10. Apparatus according to claim 9, wherein for common pivoting of the first and second pairs of two-armed levers (16, 35) carrying the impression roller (13) and the supporting roller (34) in lift-off direction, said first pair of two-armed levers (16) is provided with a stopper (38) which engages with the second pair of two-armed levers (35) when the supporting roller (34) is lifted off the impression roller (13) by a certain distance.

11. Apparatus according to claim 9, wherein at least one of two-armed lever the second pair of two-armed levers (35) is spaced from a stopper (40) adjustable via a spindle drive, said stopper (40) being supported on a corresponding lever arm of the first pair of two-armed levers (16).

12. Apparatus according to claim 11, wherein the spindle drive is driven by an air motor (42) and a gear is provided with a setting means having a scale.

* * * * *